US011331768B2

(12) United States Patent
Kashiwagi et al.

(10) Patent No.: US 11,331,768 B2
(45) Date of Patent: May 17, 2022

(54) POLISHING HEAD AND POLISHING APPARATUS

(71) Applicant: EBARA CORPORATION, Tokyo (JP)

(72) Inventors: Makoto Kashiwagi, Tokyo (JP); Fong-Jie Du, Tokyo (JP); Manao Hoshina, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 532 days.

(21) Appl. No.: 16/222,779

(22) Filed: Dec. 17, 2018

(65) Prior Publication Data

US 2019/0184519 A1 Jun. 20, 2019

(30) Foreign Application Priority Data

Dec. 20, 2017 (JP) ..... JP2017-243952

(51) Int. Cl.
*B24B 37/30* (2012.01)
*B24B 21/08* (2006.01)
(Continued)

(52) U.S. Cl.
CPC ..... *B24B 37/30* (2013.01); *B24B 7/228* (2013.01); *B24B 21/004* (2013.01); *B24B 21/08* (2013.01); *B24B 49/12* (2013.01); *B24B 41/067* (2013.01)

(58) Field of Classification Search
CPC ..... B24B 21/004; B24B 21/08; B24B 7/22; B24B 7/228; B24B 21/04; B24B 21/10;
(Continued)

(56) References Cited

U.S. PATENT DOCUMENTS 4,320,429 A * 3/1982 Knerich ..... G11B 17/32 360/130.3
4,527,359 A 7/1985 Stump et al.
(Continued)

FOREIGN PATENT DOCUMENTS

CN 101054966 A * 10/2007 ..... F04B 43/02
CN 101054966 A 10/2007
(Continued)

OTHER PUBLICATIONS

See DE1777412A1 translation attached (Year: 1974).*
(Continued)

*Primary Examiner* — Monica S Carter
*Assistant Examiner* — Abbie E Quann
(74) *Attorney, Agent, or Firm* — BakerHostetler

(57) ABSTRACT

A polishing head having a simple construction and a compact size is disclosed. The polishing head includes: a polishing-tool pressing member for supporting a polishing tool; a movable shaft coupled to the polishing-tool pressing member; a housing which houses the movable shaft therein; and a diaphragm which forms a pressure chamber between an end portion of the movable shaft and the housing, the diaphragm including a central portion in contact with the end portion of the movable shaft, an inner wall portion connecting with the central portion and extending along a side surface of the movable shaft, a folded-back portion connecting with the inner wall portion and having a curved cross section, and an outer wall portion connecting with the folded-back portion and located outside the inner wall portion.

20 Claims, 11 Drawing Sheets

(51) Int. Cl.

| | |
|---|---|
| ***B24B 49/12*** | (2006.01) |
| ***B24B 21/00*** | (2006.01) |
| ***B24B 7/22*** | (2006.01) |
| *B24B 41/06* | (2012.01) |

(58) Field of Classification Search
CPC ..... B24B 21/12; B24B 21/14; B24B 49/12; B24B 37/30; B24B 41/067
USPC ..... 451/141, 61, 6, 41, 59, 299, 303, 307, 451/312, 313, 317
See application file for complete search history.

(56) References Cited

U.S. PATENT DOCUMENTS

| | | | | |
|---|---|---|---|---|
| 4,621,459 | A | 11/1986 | Stump et al. | |
| 4,984,395 | A * | 1/1991 | Demuth | D01G 15/38 451/49 |
| 6,312,312 | B1 * | 11/2001 | Togawa | B23Q 7/06 451/288 |
| 9,027,903 | B2 * | 5/2015 | Arekar | F16K 31/086 251/11 |
| 9,421,662 | B2 * | 8/2016 | Lee | B24B 37/02 |
| 2007/0044653 | A1 | 3/2007 | Stevenson et al. | |
| 2009/0142996 | A1 * | 6/2009 | Yasuda | B24B 37/30 451/60 |
| 2013/0232970 | A1 | 9/2013 | Mavir et al. | |

FOREIGN PATENT DOCUMENTS

| | | | | |
|---|---|---|---|---|
| CN | 101444897 | A | 6/2009 | |
| DE | 1777412 | A1 * | 7/1974 | B24B 21/08 |
| DE | 1777412 | A1 | 7/1974 | |
| JP | H10-044019 | A | 2/1998 | |
| JP | 2002-005110 | A | 1/2002 | |
| JP | 2017-148931 | A | 8/2017 | |
| WO | WO 2012/074458 | A1 | 6/2012 | |
| WO | WO-2012074458 | A1 * | 6/2012 | F16F 9/057 |

OTHER PUBLICATIONS

Translation CN101054966A (Year: 2007).*
European Patent Application No. 18213702.6; Extended Search Report; dated Jul. 4, 2019; 5 pages.

* cited by examiner

POLISHING HEAD AND POLISHING APPARATUS

CROSS REFERENCE TO RELATED APPLICATION

This document claims priority to Japanese Patent Application Number 2017-243952 filed Dec. 20, 2017, the entire contents of which are hereby incorporated by reference.

BACKGROUND

Devices such as memory circuits, logic circuits and image sensors (e.g. CMOS sensors) are becoming more highly integrated these days. In a process for forming such a device, foreign matters such as fine particles and dust may adhere to the device. Foreign matter adhering to a device can cause a short-circuit between interconnects or a circuit defect. Therefore, in order to enhance the reliability of the device, it is necessary to clean a wafer on which the device is formed to remove the foreign matter on the wafer.

The above-described foreign matters, such as fine particles and dust, may adhere also to a back surface (non-device surface) of a wafer. When such foreign matter adheres to the back surface of a wafer, the wafer may separate from a stage reference surface in an exposure apparatus, or a front surface of the wafer may be inclined with respect to the stage reference surface, resulting in patterning deviation or deviation of focal distance. To prevent such problems, it is necessary to remove foreign matter adhering to a back surface of a wafer.

A conventional polishing unit performs polishing of a back surface of a wafer with a polishing head while rotating the wafer by means of a substrate rotating mechanism (see, for example, Japanese Patent Laid-Open Publication No. 2017-148931). However, the polishing head described in this patent document 1 has an air cylinder in its interior, and therefore has a large overall size and a complicated structure. Especially because of limited space under a wafer, in some cases, the large-sized polishing head cannot be disposed under the wafer.

SUMMARY OF THE INVENTION

According to an embodiment, there is provided a polishing head having a simple construction and a compact size. According to an embodiment, there is provided a polishing apparatus including the polishing head.

Embodiments, which will be described below, relate to a polishing head for pressing a polishing tool against a surface of a substrate such as a wafer. The below-described embodiments also relate to a polishing apparatus for polishing a substrate with the polishing head.

In an embodiment, there is provided a polishing head for pressing a polishing tool against a substrate, comprising: a polishing-tool pressing member for supporting a polishing tool; a movable shaft coupled to the polishing-tool pressing member; a housing which houses the movable shaft therein; and a diaphragm which forms a pressure chamber between an end portion of the movable shaft and the housing, the diaphragm including a central portion in contact with the end portion of the movable shaft, an inner wall portion connecting with the central portion and extending along a side surface of the movable shaft, a folded-back portion connecting with the inner wall portion and having a curved cross section, and an outer wall portion connecting with the folded-back portion and located outside the inner wall portion.

In an embodiment, the movable shaft has a vent hole, one open end of the vent hole communicates with the atmosphere, and other open end of the vent hole is located in a side surface of the movable shaft and outside the pressure chamber.

In an embodiment, the polishing head further comprises a universal joint located between the polishing-tool pressing member and the movable shaft.

In an embodiment, the universal joint is housed in the polishing-tool pressing member.

In an embodiment, the universal joint includes: a first support shaft perpendicular to an axial direction of the movable shaft; a tiltable body which is supported by the first support shaft and is rotatable about the first support shaft; and a second support shaft which is fixed to the tiltable body and is perpendicular to the first support shaft.

In an embodiment, the polishing head further comprises a distance sensor configured to measure a movement distance of the movable shaft relative to the housing, the distance sensor facing the end portion of the movable shaft.

In an embodiment, the distance sensor is an optical distance sensor.

In an embodiment, the polishing head further comprises a distance monitoring device configured to issue an alarm signal when a measured value of the movement distance, sent from the distance sensor, is larger than a threshold value, or smaller than a threshold value.

In an embodiment, there is provided a polishing apparatus comprising: a substrate holder for holding a substrate; and the polishing head for polishing the substrate.

The movable shaft and the polishing-tool pressing member move according to the pressure in the pressure chamber formed by the diaphragm. The pressure chamber is smaller than an air cylinder, and therefore the overall size of the polishing head can be made compact. Further, the diaphragm, having the inner wall portion, the curved folded-back portion and the outer wall portion, can deform freely in response to a change in the pressure in the pressure chamber without generating a significant tension. Accordingly, the movable shaft in contact with the diaphragm is pushed by a force that directly reflects the pressure in the pressure chamber. More specifically, when the pressure in the pressure chamber is increased, the movable shaft can move toward a substrate without receiving a significant reaction force from the diaphragm. This enables the polishing-tool pressing member, coupled to the movable shaft, to press a polishing tool (e.g. a polishing tape) against the substrate with a precisely controlled force.

DESCRIPTION OF EMBODIMENTS

Embodiments will now be described with reference to the drawings.

Figure 1:
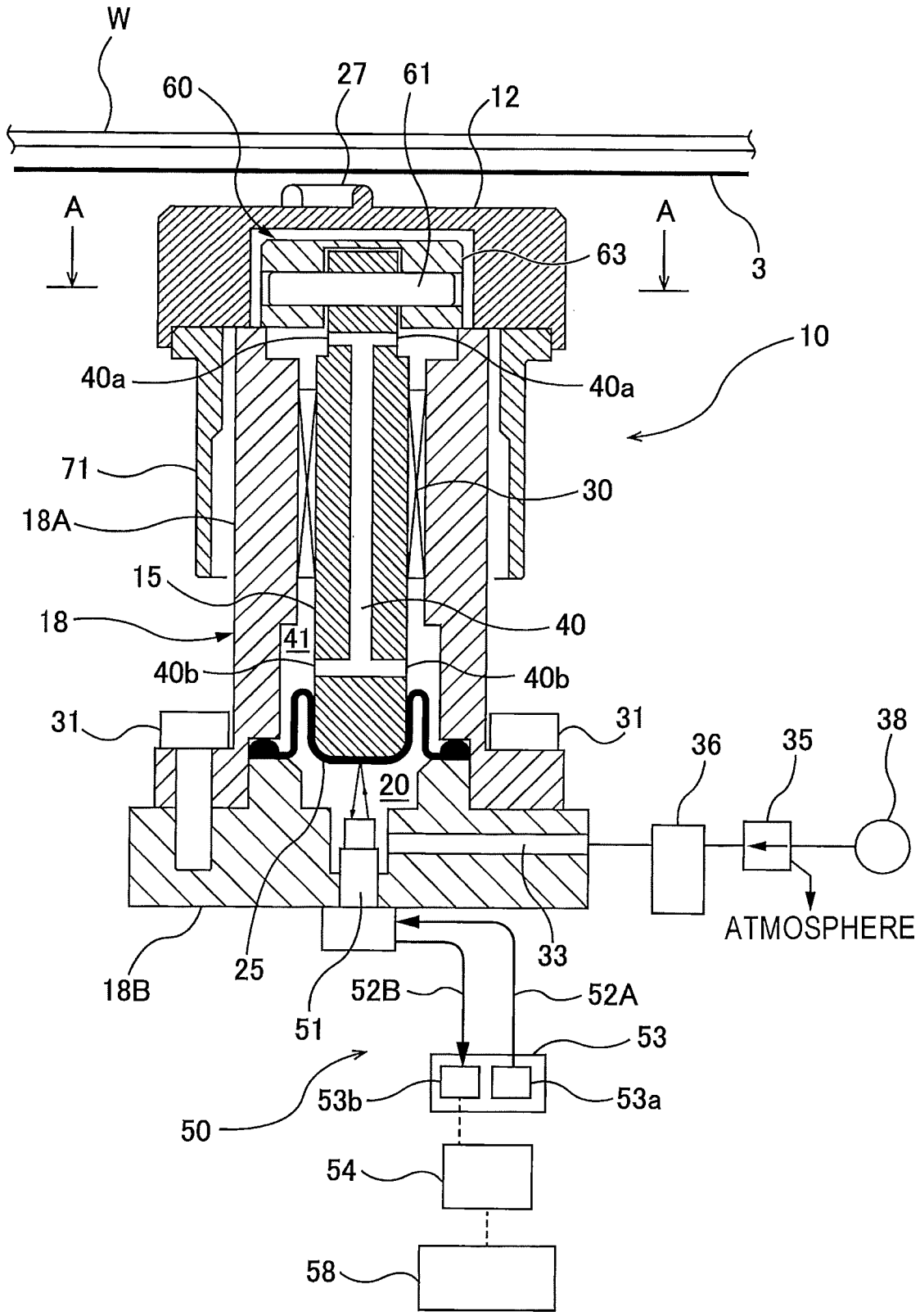
FIG. 1 is a cross-sectional view of a polishing head for pressing a polishing tape against a surface of a wafer, which is an exemplary substrate.

FIG. 1 is a cross-sectional view of a polishing head for pressing a polishing tape against a surface of a wafer, which is an exemplary substrate. A polishing head 10 includes a polishing-tool pressing member 12 for supporting a polishing tape 3 which is an example of a polishing tool, a movable shaft 15 coupled to the polishing-tool pressing member 12, a housing 18 which houses the movable shaft 15 therein, and a diaphragm 25 which forms a pressure chamber 20 between an end portion of the movable shaft 15 and the housing 18. The polishing-tool pressing member 12 has a polishing blade 27 which is inclined obliquely with respect to an advancing direction of the polishing tape 3. The back surface of the polishing tape 3 is supported by the polishing blade 27. The back surface of the polishing tape 3 is opposite to a polishing surface having abrasive particles. The polishing blade 27 may be formed of a resin material, such as PEEK (polyether ether ketone).

The movable shaft 15 is movable in its axial direction within the housing 18. In this embodiment the movable shaft 15 is comprised of a ball spline shaft. A ball spline nut 30 is disposed in the housing 18, and the movable shaft 15 is vertically movably supported by the ball spline nut 30. In one embodiment, the movable shaft 15 may be movably supported by an inner surface of the housing 18.

The housing 18 includes a housing body 18A having an interior space in which the movable shaft 15 is housed, and a lid 18B that closes the space. The lid 18B is detachably fixed by screws 31 to the housing body 18A. A rim of the diaphragm 25 is sandwiched between the housing body 18A and the lid 18B. When the lid 18B is detached from the housing body 18A, the diaphragm 25 can be removed from the housing 18. The pressure chamber 20 is formed by the diaphragm 25 and the inner surface of the housing 18. More specifically, the pressure chamber 20 is formed by the diaphragm 25 and the inner surface of the lid 18B. A compressed-gas flow passage 33, which communicates with the pressure chamber 20, is formed in the lid 18B of the housing 18. The compressed-gas flow passage 33 is coupled to a compressed-gas supply source 38 via a pressure regulator 36 and a switching valve 35. The switching valve 35 is a valve for allowing the compressed-gas flow passage 33 to selectively communicate with the compressed-gas supply source 38 or the atmosphere. A three-way valve may be used as the switching valve 35. The compressed-gas supply source 38 may be a pump, or a compressed-gas supply line which has been pre-installed as a utility in a factory.

Figure 2:
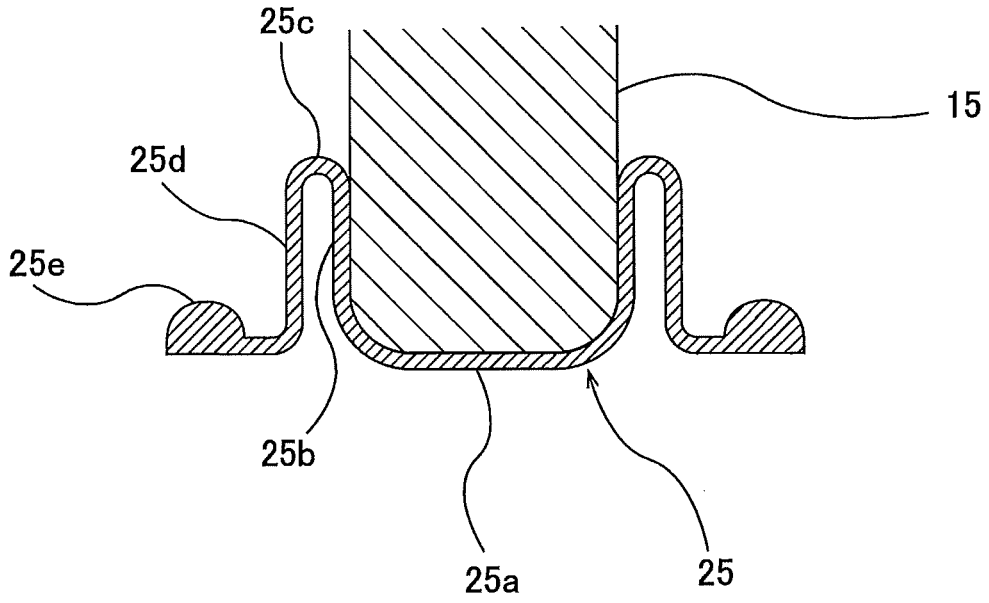
FIG. 2 is a cross-sectional view of a diaphragm.

FIG. 2 is a cross-sectional view of the diaphragm 25. The diaphragm 25 has a central portion 25*a* in contact with the end portion (or a lower end) of the movable shaft 15, an inner wall portion 25*b* connecting with the central portion 25*a* and extending along a side surface of the movable shaft 15, a folded-back portion 25*c* connecting with the inner wall portion 25*b* and having a curved cross section, and an outer wall portion 25*d* connecting with the folded-back portion 25*c* and located outside the inner wall portion 25*b*. In this embodiment, the diaphragm 25 is in contact with a lower portion of the movable shaft 15. The central portion 25*a* has a circular shape and supports the end portion (lower end) of the movable shaft 15. The folded-back portion 25*c* is curved upward. The inner wall portion 25*b* and the outer wall portion 25*d* each have a cylindrical shape, and the inner wall portion 25*b* is in contact with the side surface of the movable shaft 15. The outer wall portion 25*d* is arranged so as to surround the inner wall portion 25*b*.

The diaphragm 25 is merely in contact with the movable shaft 15, and is not fixed to the movable shaft 15. A thick portion 25*e*, constituting the rim of the diaphragm 25, is sandwiched between the housing body 18A and the lid 18B. The diaphragm 25 is formed of a flexible material. Examples of the material of the diaphragm 25 may include chloroprene rubber, fluororubber, and silicone rubber. Chloroprene rubber having high flex fatigue resistance is preferably used.

Figure 3:
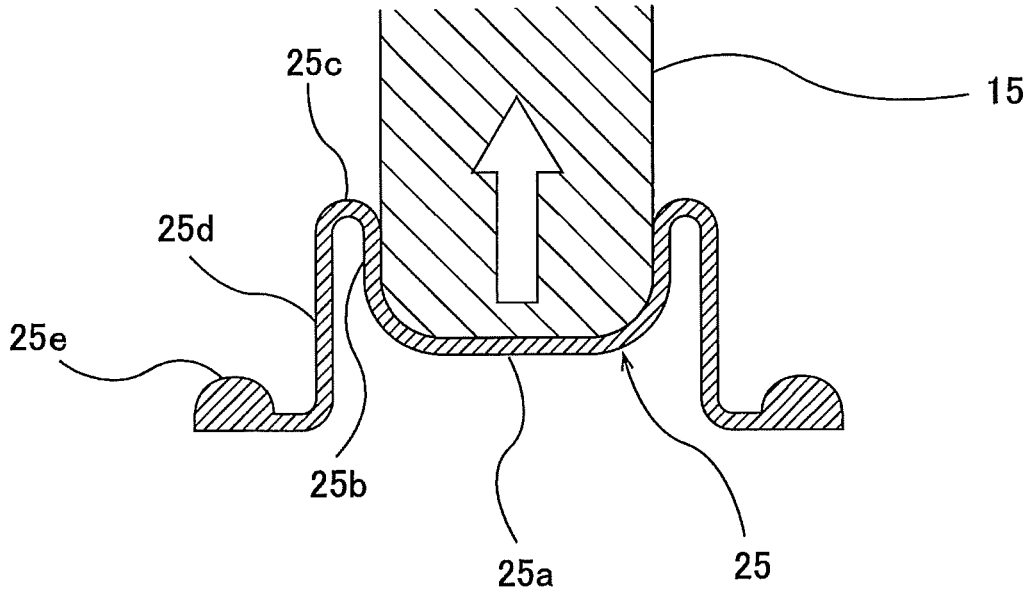
FIG. 3 is a diagram showing a manner in which a compressed gas pushes up a central portion and an inner wall portion of the diaphragm and, at the same time, pushes up a movable shaft.

As shown in FIG. 3, when a compressed gas is introduced into the pressure chamber 20, the pressure of the compressed gas pushes up the central portion 25*a* and the inner wall portion 25*b* of the diaphragm 25 and, at the same time, pushes up the movable shaft 15. During the upward movement of the movable shaft 15, a part of the inner wall portion 25*b* becomes a part of the folded-back portion 25*c*, and a part of the folded-back portion 25*c* becomes a part of the outer wall portion 25*d*, while the folded-back portion 25*c* retains its shape. When the pressure chamber 20 is opened to the atmosphere, the central portion 25*a* and the inner wall portion 25*b* of the diaphragm 25 move downward and, at the same time, the movable shaft 15 moves downward. During the downward movement of the movable shaft 15, a part of the outer wall portion 25*d* becomes a part of the folded-back portion 25*c*, and a part of the folded-back portion 25*c* becomes a part of the inner wall portion 25*b*, while the folded-back portion 25*c* retains its shape. Such a motion of the diaphragm 25 enables the movable shaft 15 to smoothly move vertically without receiving a significant reaction force from the diaphragm 25.

Figure 4:
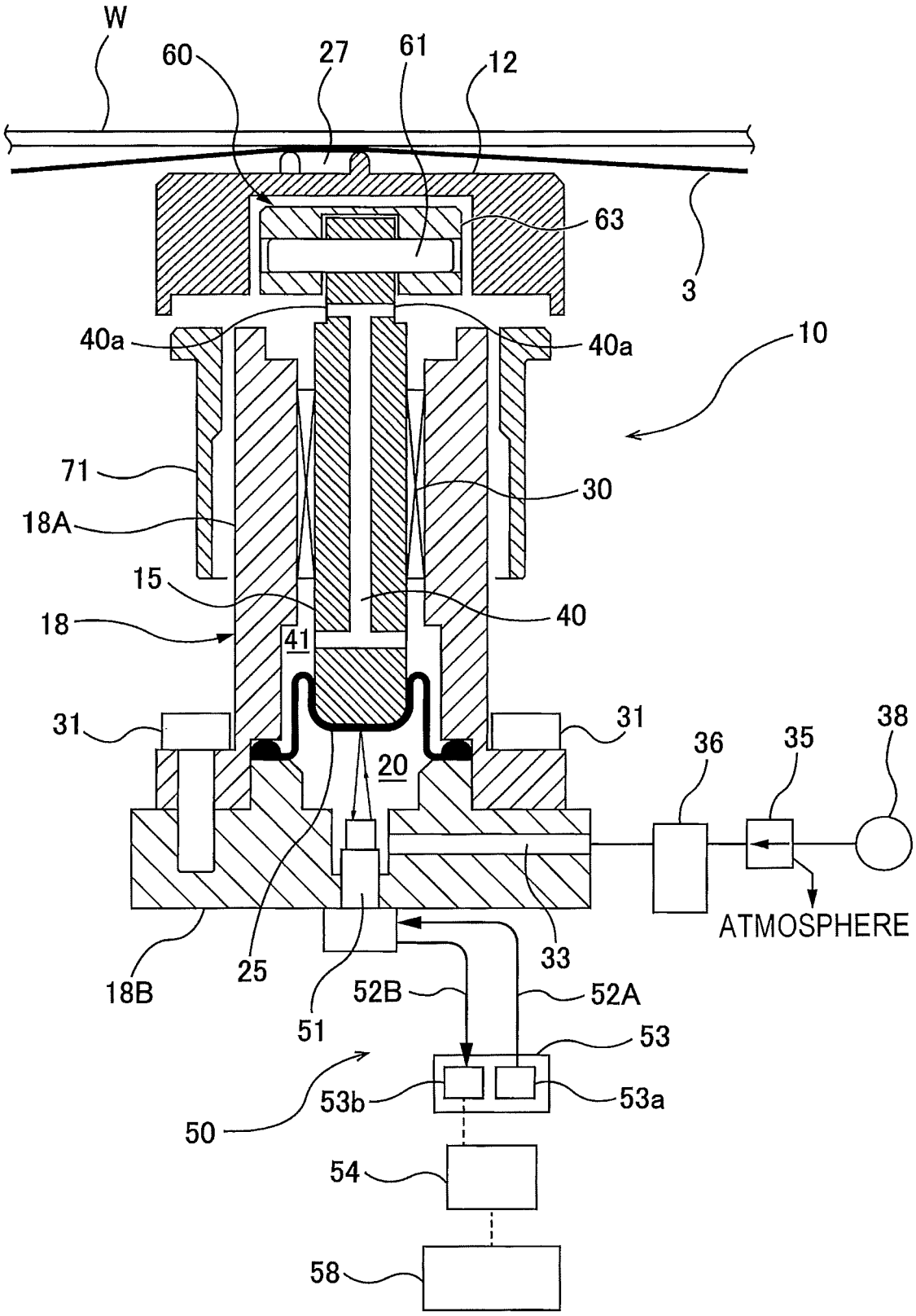
FIG. 4 is a diagram showing the movable shaft and a polishing-tool pressing member in a raised position.

When a wafer W is to be polished, the switching valve 35 is operated to provide a fluid communication between the compressed-gas flow passage 33 and the compressed-gas supply source 38. A compressed gas, such as compressed air, is supplied from the compressed-gas supply source 38 through the compressed-gas flow passage 33 to the pressure chamber 20. The pressure of the compressed gas in the pressure chamber 20 is controlled by the pressure regulator 36. The pressure of the compressed gas in the pressure chamber 20 acts on the end portion (lower end) of the movable shaft 15 through the diaphragm 25 to raise the movable shaft 15 and the polishing-tool pressing member 12. FIG. 4 shows the movable shaft 15 and the polishing-tool pressing member 12 in a raised position. The polishing blade 27 of the polishing-tool pressing member 12 can press the polishing tape 3 against the lower surface of the wafer W.

When polishing of the wafer W is to be terminated, the switching valve 35 is operated to provide a fluid communication between the compressed-gas flow passage 33 and the atmosphere. The pressure chamber 20 is opened to the atmosphere and, as a result, the movable shaft 15 and the polishing-tool pressing member 12 move downward to a retreat position shown in FIG. 1 by the weight of the movable shaft 15 and the tension of the polishing tape 3.

The movable shaft 15 and the polishing-tool pressing member 12 move according to the pressure in the pressure chamber 20 formed by the diaphragm 25. The pressure chamber 20 is smaller than an air cylinder, and therefore the entirety of the polishing head 10 can be made compact. Further, the diaphragm 25, having the inner wall portion 25*b*, the curved folded-back portion 25*c*, and the outer wall portion 25*d*, can deform freely in response to a change in the pressure in the pressure chamber 20 without generating a significant tension. Accordingly, the movable shaft 15 in contact with the diaphragm 25 is pushed by a force that directly reflects the pressure in the pressure chamber 20. More specifically, when the pressure in the pressure chamber 20 is increased, the movable shaft 15 can move toward the wafer W without receiving a significant reaction force from the diaphragm 25. This enables the polishing-tool pressing member 12, coupled to the movable shaft 15, to press the polishing tape 3 against the wafer W with a precisely controlled force.

The movable shaft 15 has a vent hole 40 formed therein. One open end 40*a* of the vent hole 40 communicates with the atmosphere, while the other open end 40*b* of the vent hole 40 is located in the side surface of the movable shaft 15 and outside the pressure chamber 20. More specifically, the open end 40*b* of the vent hole 40 communicates with a space 41 formed by the inner surface of the housing 18, the side surface of the movable shaft 15, and the diaphragm 25. The space 41 is located outside the pressure chamber 20. As the movable shaft 15 moves upward, air in the space 41 is released through the vent hole 40 into the atmosphere. The vent hole 40 is provided to ensure smooth movement of the movable shaft 15.

At least a part of a distance sensor 50 for measuring a distance of movement of the movable shaft 15 relative to the housing 18 is located in the pressure chamber 20. The entirety of the distance sensor 50 may be disposed in the pressure chamber 20. The distance sensor 50 of this embodiment is a non-contact optical distance sensor. The distance sensor 50 includes a sensor head 51 having a light-emitting element and a light-receiving element (both not shown) provided at the front end of the sensor head 51, an amplifier 53 coupled to the sensor head 51 by a light-emitting optical fiber cable 52A and a light-receiving optical fiber cable 52B, and a distance calculator 54 electrically connected to the amplifier 53. The sensor head 51 is secured to the lid 18B of the housing 18, while the amplifier 53 and the distance calculator 54 are located at a distance from the polishing head 10. When the lid 18B is detached from the housing body 18A, the sensor head 51 is also detached from the housing 18. The front end of the distance sensor 50, i.e. the front end of the sensor head 51, faces the end portion of the movable shaft 15 (more specifically the central portion 25*a* of the diaphragm 25 which is in contact with the end portion of the movable shaft 15).

The amplifier 53 has a light source 53*a* for emitting light, and a light-intensity measuring device 53*b* for measuring the intensity of light. The light emitted from the light source 53*a* of the amplifier 53 is transmitted through the light-emitting optical fiber cable 52A to the sensor head 51. The sensor head 51 directs the light to the central portion 25*a* of the diaphragm 25 (or the bottom of the diaphragm 25 in FIG. 1), and receives reflected light from the diaphragm 25. A sensor target may be fixed to the bottom of the diaphragm 25. The reflected light is transmitted through the light-receiving optical fiber cable 52B to the amplifier 53. The light-intensity measuring device 53*b* of the amplifier 53 measures the intensity of the reflected light. The amplifier 53 sends a measured value of the intensity of the reflected light to the distance calculator 54, and the distance calculator 54 converts the measured value of the intensity of the reflected light into a distance. The distance obtained by the distance calculator 54 is a distance between the diaphragm 25 and a preset reference position. The thus-constructed distance sensor 50 can measure the movement distance of the movable shaft 15 when the movable shaft 15 moves from the retreat position shown in FIG. 1 to a polishing position shown in FIG. 4.

Only the sensor head 51 of the components of the optical distance sensor 50 is mounted to the polishing head 10. The sensor head 51 only functions to emit light and receive reflected light, and therefore is very compact per se. Accordingly, the overall size of the polishing head 10 can be made small. Though not shown diagrammatically, in one embodiment, any other type of non-contact distance sensor or any contact distance sensor may be used as the distance sensor 50 as long as it has a small size.

The distance sensor 50 is coupled to a distance monitoring device 58, and a measured value of the movement distance of the movable shaft 15 is sent from the distance sensor 50 to the distance monitoring device 58. The distance monitoring device 58 may be comprised of a dedicated computer or a general-purpose computer, having a storage device (such as HDD or SSD) and a processing unit (such as CPU). The distance monitoring device 58 is configured to issue an alarm signal when a measured value of the movement distance is larger than a threshold value, or smaller than a threshold value. When a measured value of the movement distance is larger than a threshold value, the wafer W may possibly not be held properly by a below-described substrate holder. When a measured value of the movement distance is smaller than a threshold value, the polishing tape 3 on the polishing-tool pressing member 12 may possibly not be in contact with the wafer W.

Figure 5:
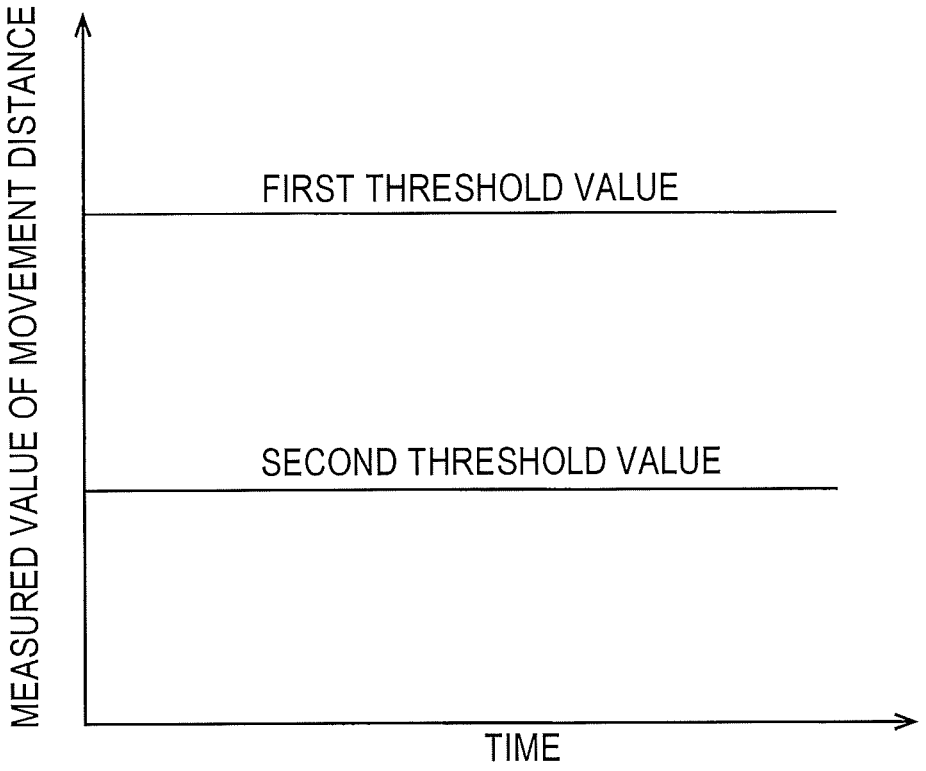
FIG. 5 is a graph illustrating a first threshold value and a second threshold value provided for a measured value of a movement distance of the movable shaft.

A first threshold value and a second threshold value may be set for measured value of the movement distance. In particular, the distance monitoring device 58 is configured to issue an alarm signal when a measured value of the movement distance is larger than the first threshold value, and to issue an alarm signal when a measured value of the movement distance is smaller than the second threshold value. FIG. 5 is a graph illustrating the first threshold value and the second threshold value, set for measured values of the movement distance of the movable shaft 15. The first threshold value is larger than the second threshold value. A range from the second threshold value to the first threshold value indicates a normal polishing position.

When the movable shaft 15 is in the retreat position shown in FIG. 1, a measured value of the movement distance is smaller than the second threshold value. When the compressed gas is supplied into the pressure chamber 20, the movable shaft 15 and the polishing-tool pressing member 12 move toward the wafer W. When a measured value of the movement distance of the movable shaft 15 is in the range from the second threshold value to the first threshold value, it is determined that the polishing tape 3 is in contact with the wafer W properly. When a measured value of the movement distance of the movable shaft 15 is larger than the first threshold value, or when a measured value of the movement distance is smaller than the second threshold value while the compressed gas is being supplied into the pressure chamber 20, the polishing tape 3 may not be in contact with the wafer W properly. Therefore, the distance monitoring device 58 issues an alarm signal.

As shown in FIG. 1, the polishing-tool pressing member 12 is coupled to the upper end of the movable shaft 15 via a universal joint 60. The universal joint 60 permits the polishing-tool pressing member 12 to tilt in all directions relative to the movable shaft 15. The universal joint 60 is arranged between the movable shaft 15 and the polishing-tool pressing member 12, and housed in the polishing-tool pressing member 12. Such arrangement makes it possible to reduce a moment caused by a reaction force applied from the wafer W to the polishing-tool pressing member 12 when the polishing tape 3 is in contact with the wafer W. Therefore, the posture of the polishing head 10 can be stabilized.

Figure 6:
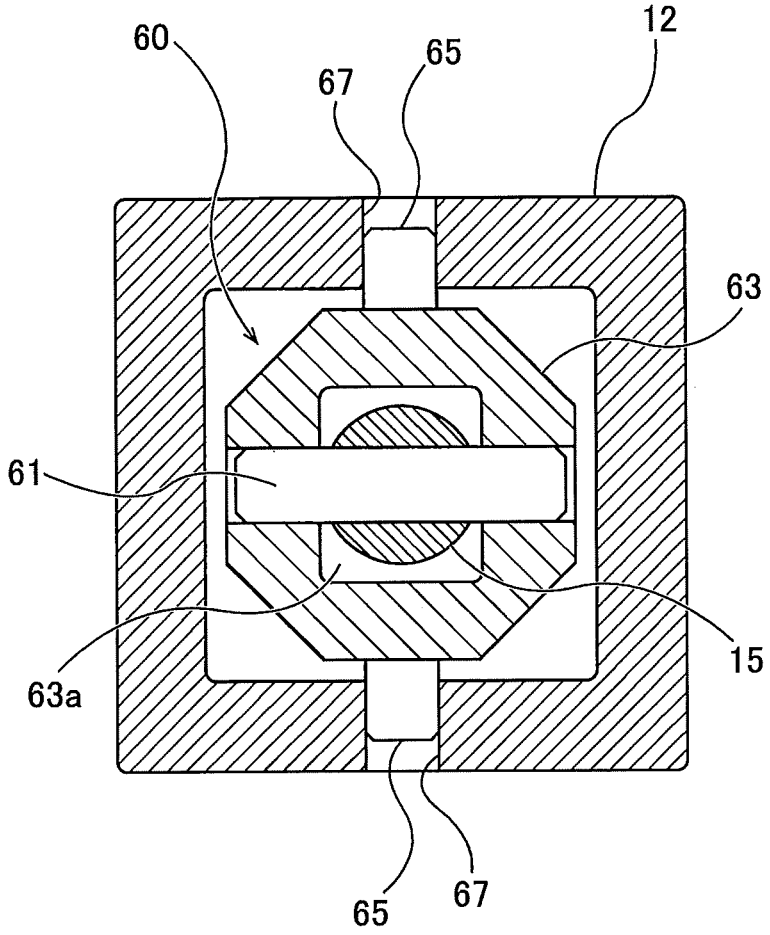
FIG. 6 is a cross-sectional view taken along line A-A of FIG. 1.

FIG. 6 is a cross-sectional view taken along line A-A of FIG. 1. The universal joint 60 includes a first support shaft 61 perpendicular to the axial direction of the movable shaft 15, a tiltable body 63 which is rotatable about the first support shaft 61, and second support shafts 65 perpendicular to the first support shaft 61. The first support shaft 61 perpendicularly penetrates through the movable shaft 15 and is fixed to the movable shaft 15. The tiltable body 63 is supported by the first support shaft 61 and tiltable about the first support shaft 61. The tiltable body 63 has a hole 63*a* formed in its center, and the movable shaft 15 is inserted into the hole 63*a*. The second support shafts 65 are fixed to the tiltable body 63, and extend outward from side surfaces of the tiltable body 63. The polishing-tool pressing member 12 has holes 67 into which the second support shafts 65 are inserted, respectively, so that the polishing-tool pressing member 12 is rotatably supported by the second support shafts 65. The polishing-tool pressing member 12 is tiltable about the second support shafts 65. Furthermore, the polishing-tool pressing member 12 is tiltable together with the tiltable body 63 about the first support shaft 61.

The universal joint 60 having the above-described construction enables the polishing-tool pressing member 12 to tilt in all directions. Therefore, when the polishing-tool pressing member 12 presses the polishing tape 3 against the surface of the wafer W, the polishing-tool pressing member 12 automatically becomes parallel to the surface of the wafer W. Thus, the universal joint 60, which tiltably supports the polishing-tool pressing member 12, allows the polishing tape 3 to be uniformly pressed against the surface of the wafer W.

As shown in FIG. 1, a skirt 71 is secured to the polishing-tool pressing member 12. The skirt 71 extends downward from the polishing-tool pressing member 12 and surrounds an upper portion of the housing 18. In this embodiment the skirt 71 has a cylindrical shape; however, the skirt 71 may have any other shape as long as the skirt 71 can surround an upper portion of the housing 18. The skirt 71 can prevent a polishing liquid such as pure water, used in polishing of the wafer W, from entering the interior of the universal joint 60 or the housing 18.

The polishing head 10 having the above-described construction has a compact overall size, and therefore can be disposed under the wafer W. It may also be possible to dispose a plurality of polishing heads 10 under the wafer W.

Figure 7:
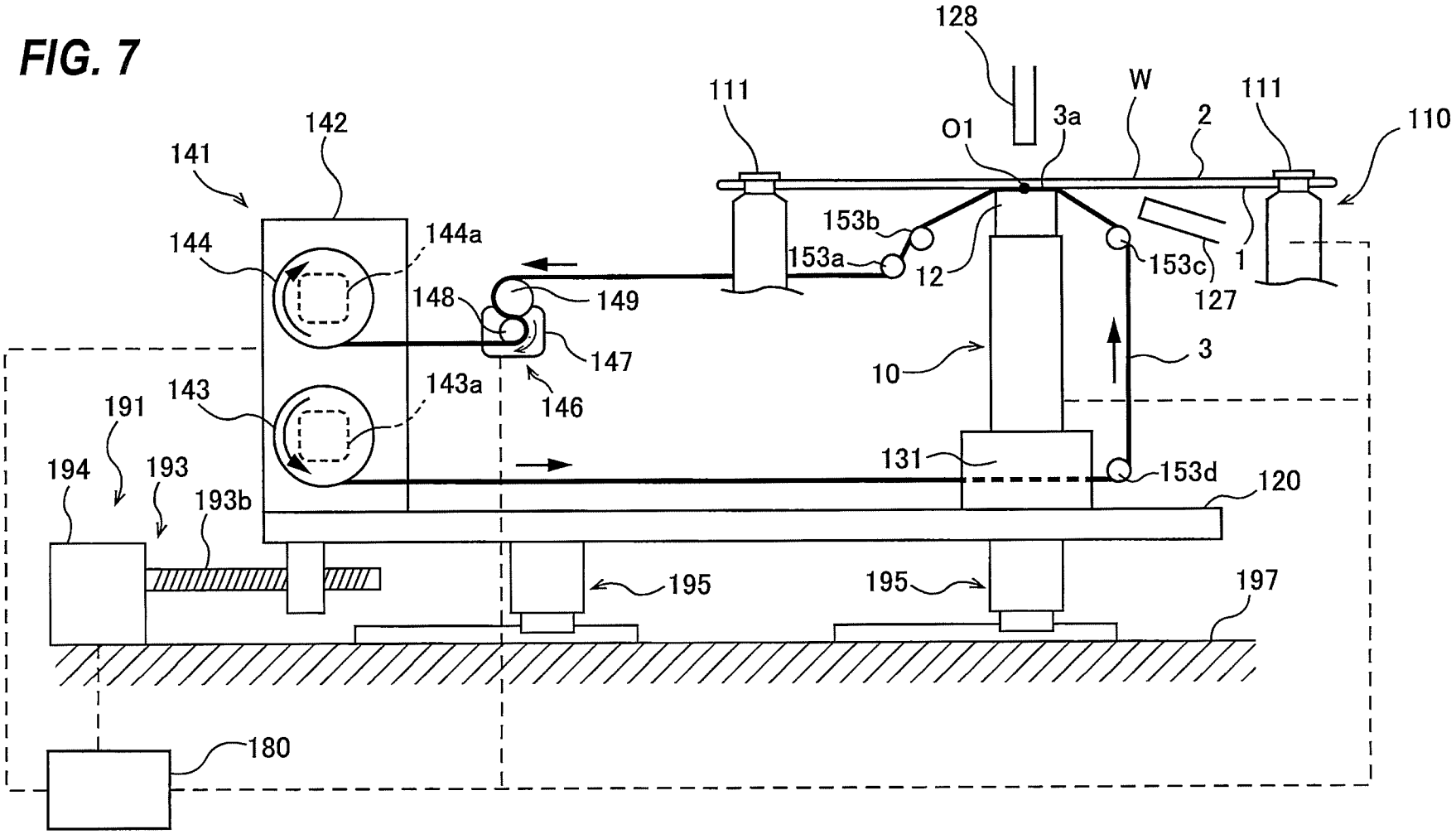
FIG. 7 is a schematic view showing an embodiment of a polishing apparatus including the above-described polishing head.

FIG. 7 is a schematic view showing an embodiment of a polishing apparatus including the above-described polishing head 10. The polishing apparatus shown in FIG. 7 includes a substrate holder 110 for holding a wafer W which is an exemplary substrate, and rotating the wafer W about its axis, the above-described polishing head 10 for bringing the polishing tape 3 as a polishing tool into contact with a first surface 1 of the wafer W, held by the substrate holder 110, to polish the first surface 1, and a polishing-tape supply mechanism 141 for supplying the polishing tape 3 to the polishing head 10.

The substrate holder 110 includes a plurality of rollers 111 which can contact the periphery of the wafer W. The polishing head 10 is disposed under the wafer W held by the substrate holder 110. The depiction of the substrate holder 110 has been partly omitted from FIG. 7.

In this embodiment, the first surface 1 of the wafer W is the back surface of the wafer W, i.e. a non-device surface where no device is formed or no device is to be formed. The second surface 2 of the wafer W, which is the opposite side from the first surface 1, is the front surface, i.e. a device surface where a device(s) is formed or a device(s) is to be formed. In this embodiment, the wafer W, with its first surface 1 facing downward, is horizontally held by the substrate holder 110.

Figure 8:
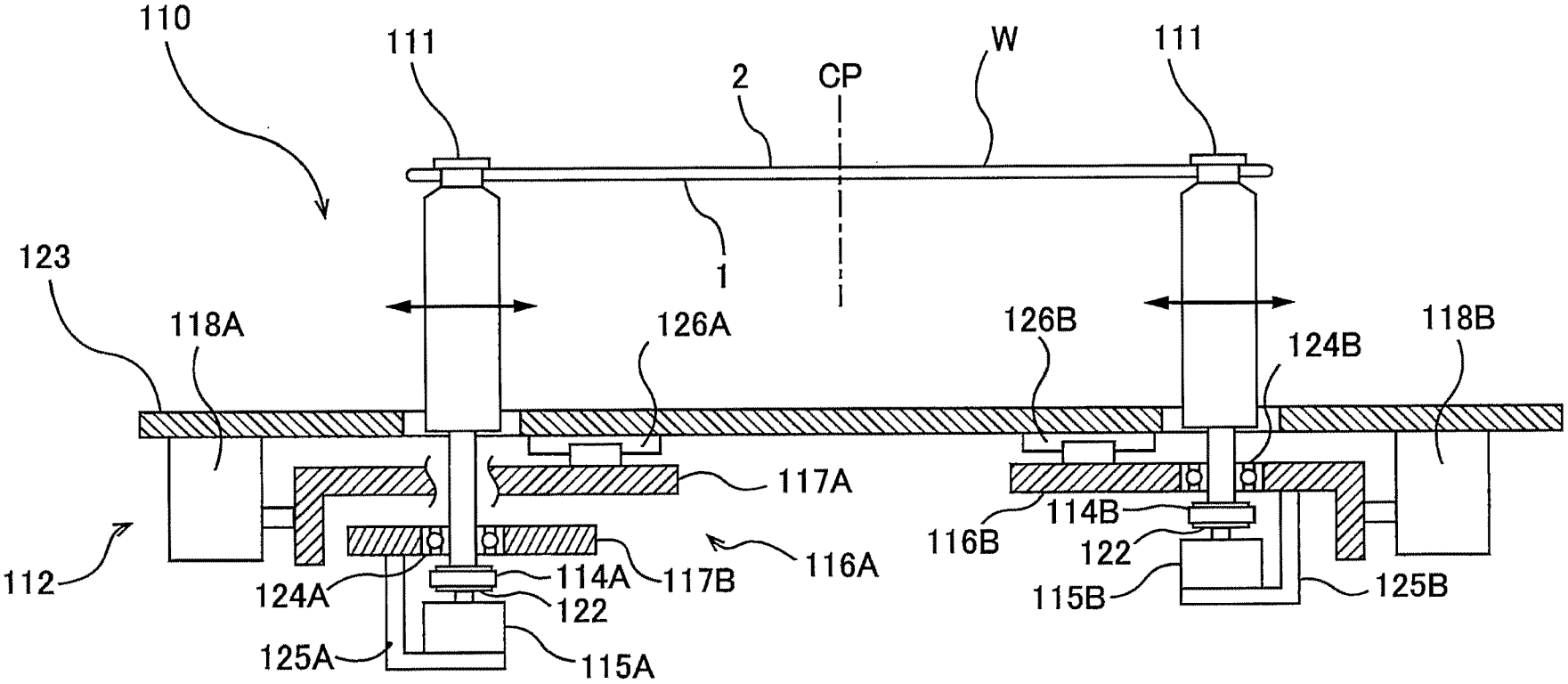
FIG. 8 is a schematic view showing details of a substrate holder.
Figure 9:
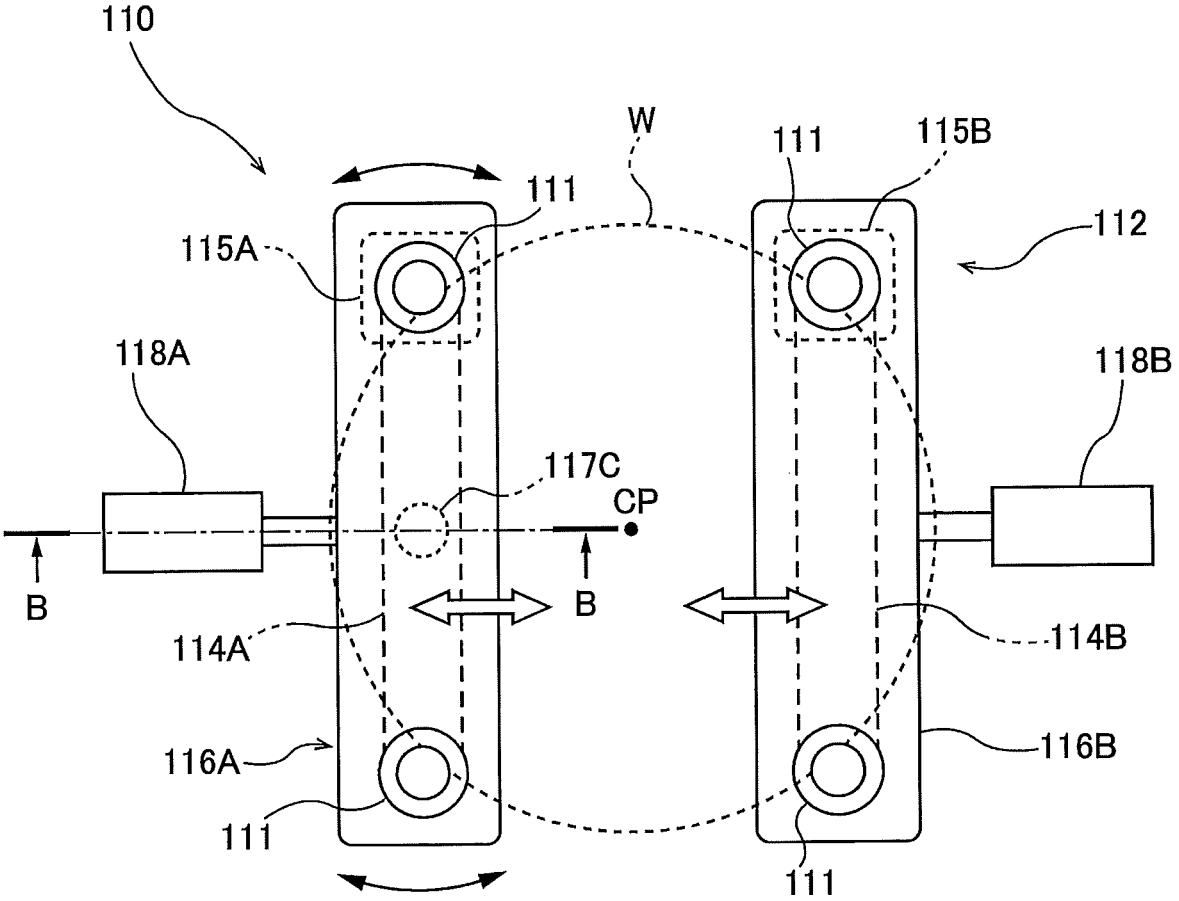
FIG. 9 is a plan view of a roller rotating mechanism shown in FIG. 8.

FIG. 8 is a schematic view showing details of the substrate holder 110, and FIG. 9 is a plan view of a roller rotating mechanism 112 shown in FIG. 8. The substrate holder 110 includes the rollers 111 which can contact the periphery of the wafer W, and the roller rotating mechanism 112 for rotating the rollers 111 about their respective own axes. Four rollers 111 are provided in this embodiment, while five or more rollers 111 may be provided. When the rollers 111 are in contact with the periphery of the wafer W (i.e. when the rollers 111 are holding the wafer W), the rollers 111 are located at the same distance from an axis CP of the substrate holder 110.

The roller rotating mechanism 112 includes a first belt 114A that couples two of the four rollers 111, a first motor 115A coupled to one of the two rollers 111 that are coupled by the first belt 114A, a first motor support 125A that supports the first motor 115A, a first roller base 116A that rotatably supports the two rollers 111 coupled by the first belt 114A, a second belt 114B that couples the other two of the four rollers 111, a second motor 115B coupled to one of the two rollers 111 that are coupled by the second belt 114B, a second motor support 125B that supports the second motor 115B, and a second roller base 116B that rotatably supports, through bearings 124B, the two rollers 111 coupled by the second belt 114B. The first roller base 116A includes an upper first roller base 117A and a lower first roller base 117B. The first motor 115A and the first belt 114A are disposed below the first roller base 116A, and the second motor 115B and the second belt 114B are disposed below the second roller base 116B. The first motor 115A is secured to the first roller base 116A via the first motor support 125A. The second motor 115B is secured to the lower surface of the second roller base 116B via the second motor support 125B.

Figure 10:
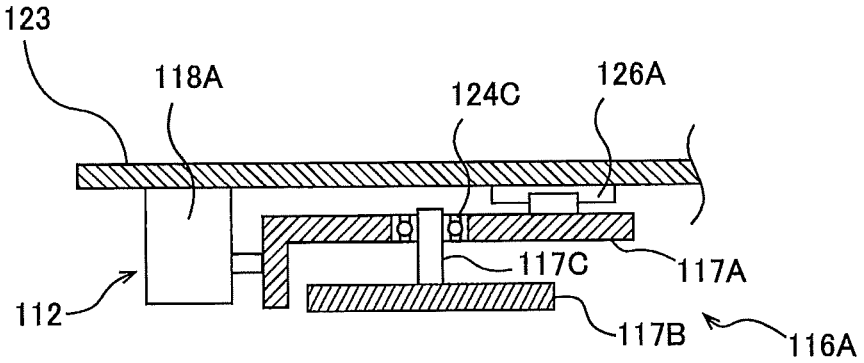
FIG. 10 is a cross-sectional view taken along line B-B of FIG. 9.

FIG. 10 is a cross-sectional view taken along line B-B of FIG. 9. As shown in FIG. 10, the first roller base 116A includes the lower first roller base 117B that rotatably supports, through bearings 124A (see FIG. 8), the two rollers 111 coupled by the first belt 114A, a pivot shaft 117C secured to the lower first roller base 117B, and the upper first roller base 117A that rotatably supports the pivot shaft 117C through a bearing 124C. The upper first roller base 117A and the lower first roller base 117B are coupled together by the pivot shaft 117C. As shown in FIG. 9, the pivot shaft 117C is located between the two rollers 111 coupled by the first belt 114A. As shown in FIG. 8, the first motor 115A is secured to the lower surface of the lower first roller base 117B via the first motor support 125A. Accordingly, the first belt 114A, the two rollers 111 coupled by the first belt 114A, the lower first roller base 117B, the first motor 115A, and the first motor support 125A can pivot together on the pivot shaft 117C.

The roller rotating mechanism 112 is configured to rotate the four rollers 111 at the same speed in the same direction. During polishing of the first surface 1 of the wafer W, the periphery of the wafer W is held by the rollers 111. The wafer W is held horizontally, and is rotated about its axis by the rotations of the rollers 111. While the four rollers 111 rotate about their respective axes during polishing of the first surface 1 of the wafer W, the positions of the rollers 111 remain stationary.

Pulleys 122 are secured to lower portions of the four rollers 111, respectively. The first belt 114A rides on the pulleys 122 secured to two of the four rollers 111, and the second belt 114B rides on the pulleys 122 secured to the other two rollers 111. The first motor 115A and the second motor 115B are configured to rotate at the same speed in the same direction. Accordingly, the four rollers 111 can rotate at the same speed in the same direction.

As shown in FIG. 9, the roller rotating mechanism 112 further includes a first actuator 118A coupled to the upper first roller base 117A of the first roller base 116A, and a second actuator 118B coupled to the second roller base 116B. The first actuator 118A moves the two rollers 111, supported by the first roller base 116A, in a horizontal direction as indicated by arrow. Similarly, the second actuator 118B moves the other two rollers 111, supported by the second roller base 116B, in a horizontal direction as indicated by arrow. Thus, the first actuator 118A and the second actuator 118B are configured to move the two sets of rollers 111 (in this embodiment each set consists of two rollers 111) in a direction closer to each other and in a direction away from each other. The first actuator 118A and the second actuator 118B may each be comprised of, for example, an air cylinder or a motor-driven actuator. In the embodiment shown in FIGS. 8 and 9, the first actuator 118A and the second actuator 118B are each comprised of an air cylinder. The first actuator 118A and the second actuator 118B are secured to a lower surface of a base plate 123.

The rollers 111 extend upwardly through the base plate 123. A first linear motion guide 126A and a second linear motion guide 126B are secured to the lower surface of the base plate 123. A movable part of the first linear motion guide 126A is coupled to the upper first roller base 117A, and a movable part of the second linear motion guide 126B is coupled to the second roller base 116B. The two linear motion guides 126A, 126B are configured to restrict movement of the rollers 111 to a linear movement in a horizontal direction.

The two sets of rollers 111 move in a direction closer to each other, until the wafer W is held by the four rollers 111. Since two of the four rollers 111 are pivotable on the pivot shaft 117C, the positions of the two rollers 111 are automatically adjusted when the four rollers 111 are holding the wafer W. The wafer W is released from the four rollers 111 when the two sets of rollers 111 move in a direction away from each other. Though the four rollers 111, arranged around the axis CP of the substrate holder 110, are provided in this embodiment, the number of rollers 111 is not limited to four. For example, it is possible to use three rollers 111, arranged around the axis CP at equal intervals, i.e. 120-degree intervals, and to provide an actuator for each roller 111. In one embodiment, three rollers 111 are arranged around the axis CP at equal angular intervals of 120 degrees, and two of the three rollers 111 are coupled by the first belt 114A. An actuator is provided for the two rollers 111 coupled by the first belt 114A, and another actuator is provided for the remaining roller 111 which is not coupled by the first belt 114A.

Figure 11:
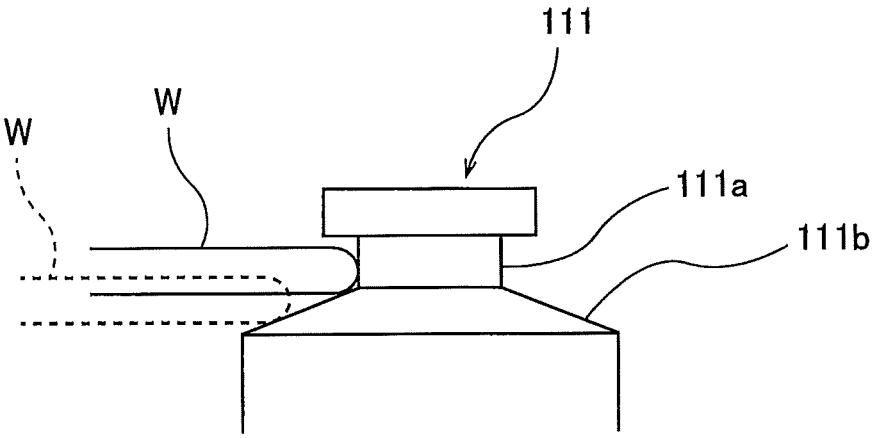
FIG. 11 is an enlarged view of a top portion of a roller.

FIG. 11 is an enlarged view of a top portion of the roller 111. The roller 111 has a cylindrical substrate-holding surface 111*a* which is capable of contacting the periphery of the wafer W, and a tapered surface 111*b* connected to the substrate-holding surface 111*a* and extending radially outward and obliquely downward from the substrate-holding surface 111*a*. The tapered surface 111*b* has a shape of a truncated cone, and has a larger diameter than the substrate-holding surface 111*a*. The wafer W is first placed on the tapered surfaces 111*b* of the rollers 111 by a not-shown transport device. Subsequently, the rollers 111 move toward the wafer W, until the periphery of the wafer W is held by the substrate-holding surfaces 111*a*. When releasing the wafer W, the rollers 111 move away from the wafer W, whereby the periphery of the wafer W leaves the substrate-holding surfaces 111*a* and is supported by the tapered surfaces 111*b* (see dotted line of FIG. 11). The not-shown transport device can remove the wafer W from the tapered surfaces 111*b*.

As shown in FIG. 7, a rinsing-liquid supply nozzle 127 for supplying a rinsing liquid (e.g. pure water or an alkaline chemical solution) to the first surface 1 of the wafer W is disposed below the wafer W held by the substrate holder 110. The rinsing-liquid supply nozzle 127 is coupled to a not-shown rinsing liquid supply source. The rinsing-liquid supply nozzle 127 is oriented toward the center O1 of the first surface 1 of the wafer W. The rinsing liquid is supplied from the rinsing-liquid supply nozzle 127 to the first surface 1 of the wafer W, and spreads on the first surface 1 of the wafer W due to the centrifugal force. The rinsing liquid flows radially outward on the first surface 1 of the wafer W, and can thereby remove polishing debris from the first surface 1 of the wafer W.

A protective-liquid supply nozzle 128 for supplying a protective liquid (e.g. pure water) to the second surface 2 of the wafer W is disposed above the wafer W held by the substrate holder 110. The protective-liquid supply nozzle 128 is coupled to a not-shown protective liquid supply source. The protective-liquid supply nozzle 128 is oriented toward the center of the second surface 2 of the wafer W. The protective liquid is supplied from the protective-liquid supply nozzle 128 to the center of the second surface 2 of the wafer W, and spreads on the second surface 2 of the wafer W due to the centrifugal force. The protective liquid prevents the rinsing liquid, containing polishing debris produced by polishing of the wafer W and other foreign matter, from flowing onto the second surface 2 of the wafer W and adhering to the second surface 2. Therefore, the second surface 2 of the wafer W can be kept clean.

Figure 12:
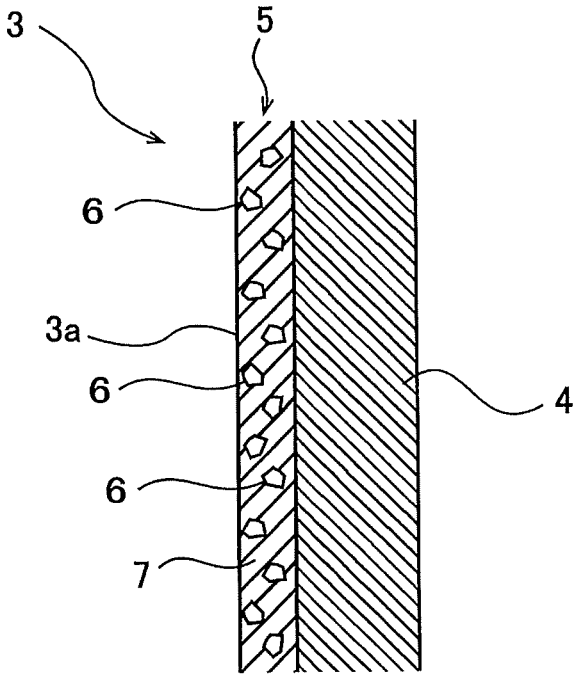
FIG. 12 is a schematic view showing an example of a polishing tape.

A polishing tape 3, having abrasive particles on one surface, is used as a polishing tool in this embodiment. FIG. 12 is a schematic view showing an example of the polishing tape 3. The polishing tape 3 shown in FIG. 12 comprises a base tape 4 and a polishing layer 5. A surface of the base tape 4 is covered with the polishing layer 5. The polishing layer 5 includes abrasive particles 6 and a binder (resin) 7 that holds the abrasive particles 6. A polishing surface 3*a* of the polishing tape 3 is constituted by an exposed surface of the polishing layer 5.

Returning back to FIG. 7, the polishing head 10 is supported by a support member 131, which is secured to a movable plate 120. Therefore, the entirety of the polishing head 10 is movable together with the movable plate 120. The support member 131 has a not-shown through-hole through which the polishing tape 3 extends.

The polishing-tape supply mechanism 141 includes a tape feed reel 143 for feeding the polishing tape 3, and a tape take-up reel 144 for collecting the polishing tape 3. The tape feed reel 143 and the tape take-up reel 144 are coupled to a tension motor 143*a* and a tension motor 144*a*, respectively. The tension motors 143*a*, 144*a* are secured to a reel base 142, and are configured to be able to exert a predetermined tension on the polishing tape 3 by applying predetermined torques to the tape feed reel 143 and the tape take-up reel 144. The reel base 142 is secured to the movable plate 120 so that the entirety of the polishing-tape supply mechanism 141 can move together with the movable plate 120.

A tape advancing device 146 for advancing the polishing tape 3 in its longitudinal direction is provided between the tape feed reel 143 and the tape take-up reel 144. The tape advancing device 146 includes a tape advancing roller 148 for advancing the polishing tape 3, a nip roller 149 for pressing the polishing tape 3 against the tape advancing roller 148, and a tape advancing motor 147 for rotating the tape advancing roller 148. The polishing tape 3 is sandwiched between the nip roller 149 and the tape advancing roller 148. When the tape advancing motor 147 rotates the tape advancing roller 148 in a direction indicated by arrow in FIG. 7, the polishing tape 3 is advanced from the tape feed reel 143 to the tape take-up reel 144 via the polishing-tool pressing member 12 of the polishing head 10. The advancing speed of the polishing tape 3 can be changed by changing the rotational speed of the tape advancing motor 147. In one embodiment, the polishing tape 3 may be advanced in a direction opposite the direction indicated by the arrow in FIG. 7 (the positions of the tape feed reel 143 and the tape take-up reel 144 may be reversed). Also in this case, the tape advancing device 146 is installed at the side of the tape take-up reel 144. The polishing tape 3 is supplied to the polishing-tool pressing member 12 such that the polishing surface 3*a* of the polishing tape 3 faces the first surface 1 of the wafer W.

The polishing apparatus further includes guide rollers 153*a*, 153*b*, 153*c*, 153*d* that support the polishing tape 3. The polishing tape 3 is guided by these guide rollers 153*a*, 153*b*, 153*c*, 153*d* so as to surround the polishing head 10. The polishing head 10 presses the polishing tape 3 against the first surface 1 of the wafer W from the back side of the polishing tape 3 by means of the polishing-tool pressing member 12, thereby polishing the first surface 1 of the wafer W. The guide rollers 153*b*, 153*c*, arranged at both sides of the polishing head 10, guide the polishing tape 3 such that the polishing tape 3 advances in a direction parallel to the first surface 1 of the wafer W.

The tape advancing device 146 and the guide rollers 153*a*, 153*b*, 153*c*, 153*d* are secured to not-shown holding members, which are secured to the movable plate 120.

In order to bring the polishing tape 3 into contact with the entirety of the first surface 1, ranging from the center O1 to the outermost area, of the wafer W, the polishing apparatus of this embodiment includes a polishing-head moving mechanism 191 for translating the polishing head 10 relative to the substrate holder 110. The polishing-head moving mechanism 191 is configured to move the polishing head 10 between the center O1 and the outermost area of the first surface 1 of the wafer W.

A plurality of linear motion guides 195 are secured to the lower surface of the movable plate 120, which is supported by these linear motion guides 195. The linear motion guides 195 are disposed on an installation surface 197. The movable plate 120 is moved by the polishing-head moving mechanism 191, and the linear motion guides 195 restrict the movement of the movable plate 120 to a linear movement in a radial direction of the wafer W.

The polishing-head moving mechanism 191 includes a ball screw mechanism 193, and a motor 194 for driving the ball screw mechanism 193. A servo motor can be used as the motor 194. The movable plate 120 is coupled to a screw shaft 193*b* of the ball screw mechanism 193. When the polishing-head moving mechanism 191 is set in motion, the polishing head 10, the polishing-tape supply mechanism 141, the tape advancing device 146, and the guide rollers 153*a*, 153*b*, 153*c*, 153*d* move relative to the substrate holder 110 in the radial direction of the wafer W.

During polishing of the wafer W, the polishing-head moving mechanism 191 moves the polishing head 10 between the center O1 and the outermost area of the first surface 1 of the wafer W. The polishing-head moving mechanism 191 is electrically connected to an operation controller 180, and the operation of the polishing-head moving mechanism 191 is controlled by the operation controller 180. When the polishing-head moving mechanism 191 is set in motion, the polishing head 10, the polishing-tape supply mechanism 141, the tape advancing device 146, and the guide rollers 153*a*, 153*b*, 153*c*, 153*d* move together.

During polishing of the wafer W, the wafer W is rotated by the rollers 111. The positions of all the rollers 111 are fixed while these rollers 111 are rotating about their axes. Therefore, even when the polishing head 10 is moved outward from the center of the wafer W by the polishing-head moving mechanism 191, the rollers 111 do not contact the polishing head 10. This enables the polishing tape 3 to polish the entirety of the surface 1, including the outermost area, of the wafer W.

Figure 13:
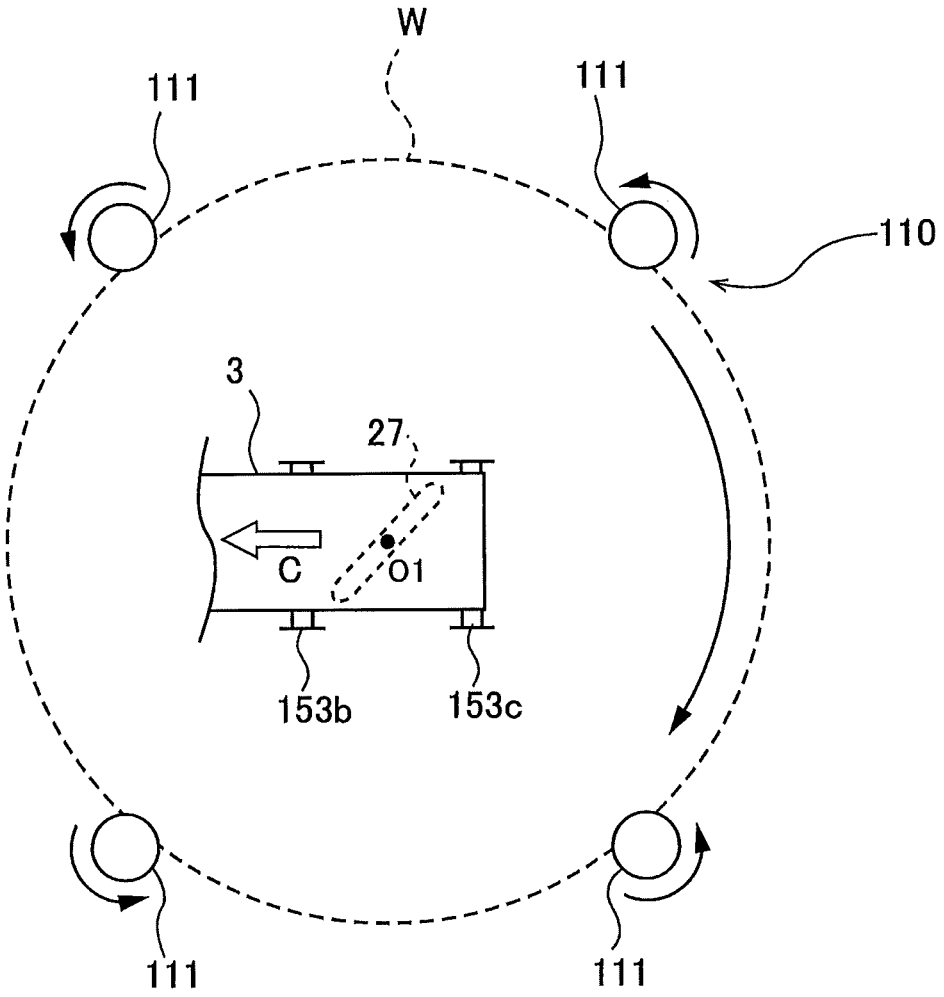
FIG. 13 is a plan view showing an arrangement of the polishing head.

FIG. 13 is a plan view showing an arrangement of the polishing head 10. As shown in FIG. 13, the polishing blade 27 is shorter than the radius of the wafer W. The polishing blade 27 extends obliquely with respect to the advancing direction of the polishing tape 3 (indicated by arrow C). In this embodiment, the advancing direction C of the polishing tape 3 coincides with the longitudinal direction of the polishing tape 3. Further, the polishing blade 27 extends over the entire width of the polishing tape 3 without protruding outside the polishing tape 3. Since the polishing blade 27 is arranged obliquely with respect to the advancing direction C of the polishing tape 3 (the longitudinal direction of the polishing tape 3), an unused portion of the polishing tape 3 can be brought into contact with the wafer W even on the downstream side in the advancing direction of the polishing tape 3 (on the peripheral side of the wafer W in this embodiment). This arrangement can prevent a reduction in the polishing rate due to the use of the polishing tape 3 which has been deteriorated by polishing. In one embodiment, the polishing blade 27 may be longer than the radius of the wafer W. Further, in one embodiment, the polishing blade 27 may be perpendicular to the advancing direction C of the polishing tape 3.

The operation of the polishing apparatus of this embodiment will now be described. The following operation of the polishing apparatus is controlled by the operation controller 180 shown in FIG. 7. The operation controller 180 is electrically connected to the substrate holder 110, the polishing head 10, the polishing-tape supply mechanism 141, the tape advancing device 146, and the polishing-head moving mechanism 191. The operations of the substrate holder 110, the rinsing-liquid supply nozzle 127, the protective-liquid supply nozzle 128, the polishing head 10, the polishing-tape supply mechanism 141, the tape advancing device 146, and the polishing-head moving mechanism 191 are controlled by the operation controller 180. The operation controller 180 is comprised of a dedicated computer or a general-purpose computer.

The wafer W, to be polished, is held by the rollers 111 of the substrate holder 110, with the first surface 1 facing downward, and is rotated about the axis of the wafer W. In particular, the substrate holder 110 rotates the wafer W by rotating the rollers 111 about their respective axes while keeping the rollers 111 in contact with the periphery of the wafer W with its first surface 1 facing downward. Next, the rinsing liquid is supplied from the rinsing-liquid supply nozzle 127 to the first surface 1 of the wafer W, and the protective liquid is supplied from the protective-liquid supply nozzle 128 to the second surface 2 of the wafer W. The rinsing liquid flows radially outward on the first surface 1 of the wafer W, and the protective liquid spreads over the entirety of the second surface 2 of the wafer W due to the centrifugal force.

The polishing-head moving mechanism 191 moves the polishing head 10 to a position below the center O1 of the first surface 1 of the wafer W. The operation controller 180 instructs the polishing-tape supply mechanism 141 and the tape advancing device 146 to advance the polishing tape 3 in its longitudinal direction at a predetermined speed while applying a predetermined tension to the polishing tape 3. Next, the polishing head 10 brings the polishing surface 3*a* of the polishing tape 3 into contact with the first surface 1 of the wafer W, thereby starting polishing of the first surface 1 in the presence of the rinsing liquid. While the polishing head 10 is pressing the polishing tape 3 against the first surface 1 of the wafer W, the polishing-head moving mechanism 191 moves the polishing head 10, the polishing-tape supply mechanism 141, the guide rollers 153*a*, 153*b*, 153*c*, 153*d*, and the tape advancing device 146 outward in the radial direction of the wafer W. During the polishing of the wafer W, the rinsing-liquid supply nozzle 127 and the protective-liquid supply nozzle 128 continually supply the rinsing liquid and the protective liquid to the wafer W.

The operation controller 180 terminates polishing of the wafer W when the polishing head 10 reaches the outermost area of the first surface 1 of the wafer W. In particular, the polishing head 10 lowers the polishing-tool pressing member 12 to separate the polishing tape 3 from the first surface 1 of the wafer W. The operation controller 180 then stops the operations of the substrate holder 110, the rinsing-liquid supply nozzle 127, the protective-liquid supply nozzle 128, the polishing-tape supply mechanism 141 and the tape advancing device 146, whereby polishing of the wafer W is terminated.

In one embodiment, the polishing-head moving mechanism 191 may reciprocate the polishing head 10 between the outermost area and the center O1 of the first surface 1 of the wafer W.

In one embodiment, instead of the polishing tape 3, a fixed abrasive, such as a grindstone, may be used as a polishing tool. The fixed abrasive may be secured to the surface of the polishing-tool pressing member 12. The polishing head 10 can polish the first surface 1 of the wafer W by bringing the fixed abrasive into contact with the first surface 1.

Figure 14:
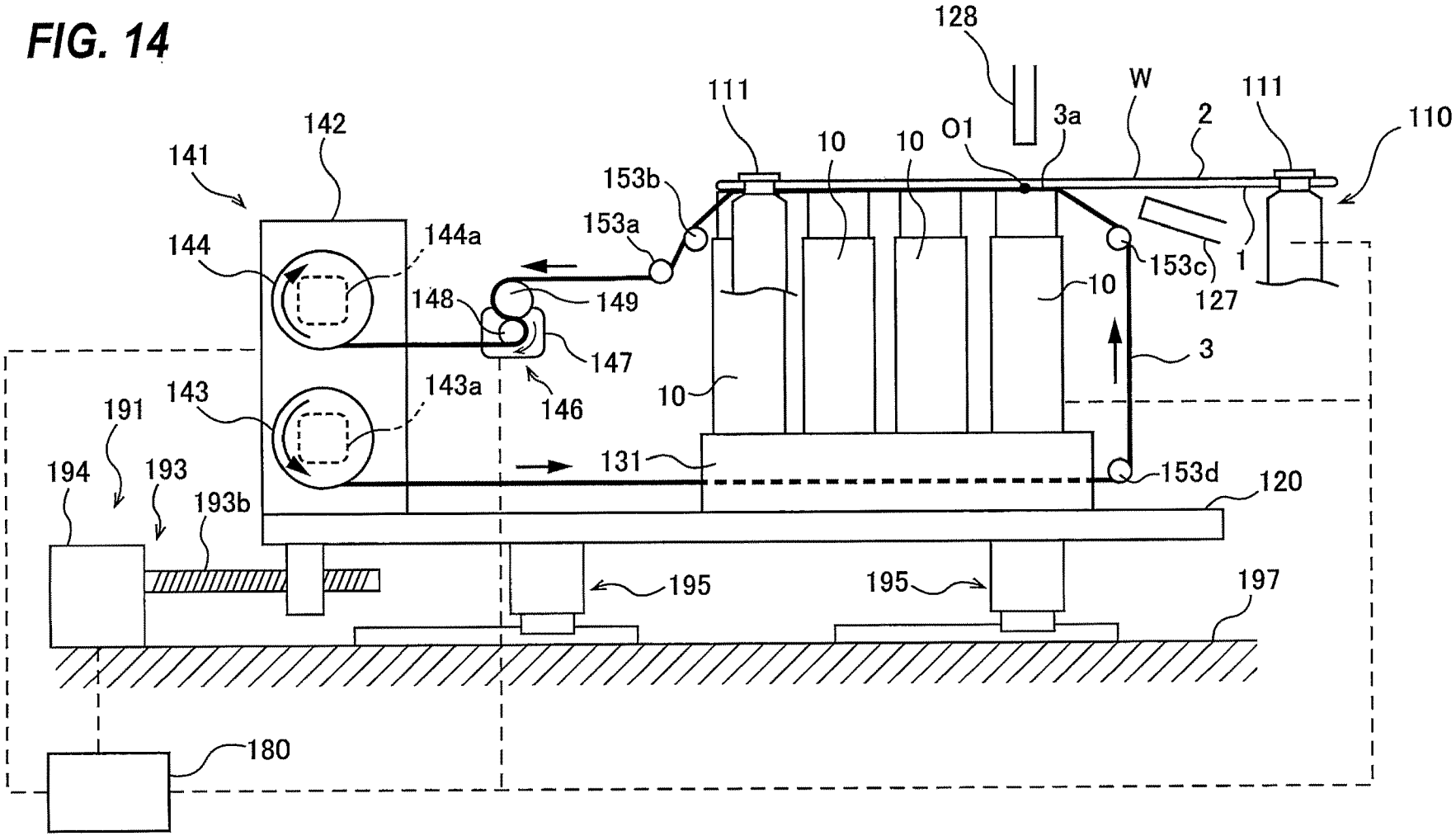
FIG. 14 is a view showing an embodiment of a polishing apparatus including a plurality of polishing heads.

The compact size of the polishing head 10 makes it possible to dispose a plurality of the polishing heads 10 under the wafer W, as shown in FIG. 14. In that case, the polishing-head moving mechanism 191 may be omitted.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing head for pressing a polishing tool against a substrate, comprising:

a polishing-tool pressing member for supporting the polishing tool;

a movable shaft coupled to the polishing-tool pressing member;

a housing which houses the movable shaft therein, the housing including a housing body having an interior space in which the movable shaft is located and a lid that closes the space; and a diaphragm which forms a pressure chamber between an end portion of the movable shaft and the housing, the diaphragm including a central portion in contact with the end portion of the movable shaft, an inner wall portion connecting with the central portion and extending along a side surface of the movable shaft, a folded-back portion connecting with the inner wall portion and having a curved cross section, an outer wall portion connecting with the folded-back portion and located outside the inner wall portion, and a rim connecting with the outer wall portion, the lid being located outside the outer wall portion, the rim being sandwiched between a first surface of the housing body and a second surface of the lid, and the second surface facing toward the movable shaft wherein:

the movable shaft has a vent hole;

one open end of the vent hole communicates with the atmosphere; and other open end of the vent hole is located in the side surface of the movable shaft and outside the pressure chamber.

2. The polishing head according to claim 1, further comprising a universal joint located between the polishing-tool pressing member and the movable shaft.

3. The polishing head according to claim 2, wherein the universal joint is housed in the polishing-tool pressing member.

4. The polishing head according to claim 1, further comprising a distance sensor configured to measure a movement distance of the movable shaft relative to the housing, the distance sensor facing the end portion of the movable shaft.

5. The polishing head according to claim 4, wherein the distance sensor is secured to the lid.

6. The polishing head according to claim 4, wherein the distance sensor is an optical distance sensor.

7. The polishing head according to claim 4, further comprising a distance monitoring device configured to issue an alarm signal when a measured value of the movement distance, sent from the distance sensor, is larger than a threshold value, or smaller than a threshold value.

8. A polishing apparatus comprising:

a substrate holder for holding a substrate; and the polishing head according to claim 1 for polishing the substrate.

9. The polishing head according to claim 1, wherein the rim extends radially outwardly from the outer wall portion.

10. The polishing head according to claim 1, wherein each of the inner wall portion and the outer wall portion has a cylindrical shape.

11. The polishing head according to claim 1, wherein the central portion of the diaphragm is not fixed to the end portion of the movable shaft.

12. The polishing head according to claim 1, wherein the lid is removably secured to the housing body by a screw.

13. A polishing head for pressing a polishing tool against a substrate, comprising:

a polishing-tool pressing member for supporting the polishing tool;

a movable shaft coupled to the polishing-tool pressing member;

a housing which houses the movable shaft therein, the housing including a housing body having an interior space in which the movable shaft is located and a lid that closes the space; and a diaphragm which forms a pressure chamber between an end portion of the movable shaft and the housing, the diaphragm including a central portion in contact with the end portion of the movable shaft, an inner wall portion connecting with the central portion and extending along a side surface of the movable shaft, a folded-back portion connecting with the inner wall portion and having a curved cross section, an outer wall portion connecting with the folded-back portion and located outside the inner wall portion, and a rim connecting with the outer wall portion, the lid being located outside the outer wall portion, the rim being sandwiched between a first surface of the housing body and a second surface of the lid, and the second surface facing toward the movable shaft;

a universal joint located between the polishing-tool pressing member and the movable shaft, wherein the universal joint includes:

a first support shaft perpendicular to an axial direction of the movable shaft;

a tiltable body which is supported by the first support shaft and is rotatable about the first support shaft; and a second support shaft which is fixed to the tiltable body and is perpendicular to the first support shaft.

14. The polishing head according to claim 13, further comprising a distance sensor configured to measure a movement distance of the movable shaft relative to the housing, the distance sensor facing the end portion of the movable shaft.

15. The polishing head according to claim 14, wherein the distance sensor is an optical distance sensor.

16. The polishing head according to claim 14, further comprising a distance monitoring device configured to issue an alarm signal when a measured value of the movement distance, sent from the distance sensor, is larger than a threshold value, or smaller than a threshold value.

17. The polishing head according to claim 13, wherein the rim extends radially outwardly from the outer wall portion.

18. The polishing head according to claim 13, wherein each of the inner wall portion and the outer wall portion has a cylindrical shape.

19. The polishing head according to claim 13, wherein the central portion of the diaphragm is not fixed to the end portion of the movable shaft.

20. The polishing head according to claim 13, wherein the lid is removably secured to the housing body by a screw.

* * * * *